US005341740A

United States Patent [19]

Guaraldi

[11] Patent Number: 5,341,740

[45] Date of Patent: Aug. 30, 1994

[54] HIGH SPEED INK FEED MECHANISM

[75] Inventor: Glenn A. Guaraldi, Kingston, N.H.

[73] Assignee: Heidelberg Harris Inc., Dover, N.H.

[21] Appl. No.: 553,717

[22] Filed: Jul. 16, 1990

[51] Int. Cl.[5] ..... B41F 31/00

[52] U.S. Cl. ..... 101/350; 101/349; 101/351

[58] Field of Search ..... 101/348–350, 101/DIG. 32, 148, 207–210, 363, 364, 351, 352

[56] References Cited

U.S. PATENT DOCUMENTS

| | | | |
|---|---|---|---|
| 2,248,645 | 7/1941 | Schlesinger | 101/DIG. 32 X |
| 3,563,173 | 2/1971 | Harless | 101/350 |
| 4,148,256 | 4/1979 | Fischer | 101/350 |
| 4,367,678 | 1/1983 | Fischer | 101/350 |
| 4,590,856 | 5/1986 | Mamberer et al. | 101/148 |

FOREIGN PATENT DOCUMENTS 2225750 6/1990 United Kingdom .

*Primary Examiner*—Edgar S. Burr
*Assistant Examiner*—Christopher A. Bennett
*Attorney, Agent, or Firm*—Tarolli, Sundheim & Covell

[57] ABSTRACT

An offset printing apparatus rotates the plate cylinder steadily with a minimum of torsional interference caused by impact of the reciprocating ductor roll with the vibrator roll. The ductor roll is reciprocated at a rapid rate to impart a rapid succession of torsional shocks to the vibrator roll and thereby to urge the gear train toward a steady-state condition wherein a level of torsional loading is maintained without substantial change in response to reciprocation of the ductor roll.

1 Claim, 1 Drawing Sheet

HIGH SPEED INK FEED MECHANISM

BACKGROUND OF THE INVENTION

The present invention relates to a printing press, and particularly relates to an improved reciprocating ductor roll for a printing press.

DESCRIPTION OF THE PRIOR ART

A printing press generally comprises a fountain roll which picks up ink from an ink fountain, a plate cylinder which carries an image to be printed, and a plurality of distributing rolls for transferring ink from the fountain roll to the plate cylinder. A ductor roll transfers ink directly from the fountain roll to a distributing roll which is usually a vibrator roll, and a series of additional distributing rolls further transfer the ink from the vibrator roll to the plate cylinder. In order to pick up ink from the fountain roll and to deposit the ink onto the vibrator roll, the ductor roll is reciprocated between a position in ink transferring relationship with the fountain roll and another position in ink transferring relationship with the vibrator roll.

The plate cylinder rotates with the surface speed of the moving web being printed. The vibrator roll and the other distributing rolls, which are driven on a conunon gear train with the plate cylinder, are driven at a relatively high speed. However, the fountain roll rotates with a surface speed substantially less than the speed of the distributing rolls. The reciprocating ductor roll therefore moves from the fountain roll to the vibrator roll with a rotating surface speed less than the rotating surface speed of the vibrator roll. Impact of the relatively slowly moving ductor roll surface with the more rapidly moving vibrator roll surface generates a torsional load in the vibrator roll. This torsional load is transmitted through the gear train to the plate cylinder. As is known, application of this torsional load to the rotating plate cylinder can disrupt transfer of the inked image off of the plate cylinder.

SUMMARY OF THE INVENTION

The present invention provides a printing apparatus in which an inked image is transferred off of a plate cylinder with a minimum of disruption caused by torsional loads generated upon impact of a reciprocating ductor roll with a distributing roll.

In accordance with the invention, a printing apparatus for transferring ink to a rotatable plate cylinder comprises a fountain roll for picking up ink from an ink fountain, a distributing roll, and a ductor roll which is movable between first and second positions. In the first position, the ductor roll is in ink transferring relationship with the fountain roll and is not in ink transferring relationship with the distributing roll. In the second position, the ductor roll is in ink transferring relationship with the distributing roll but not in ink transferring relationship with the fountain roll. The ductor roll is reciprocated through a cycle from the first position to the second position and back to the first position. Reciprocating means moves the ductor roll at a relatively high rate as compared to movement of ductor rolls in the prior art.

The invention minimizes the effect which the reciprocating ductor roll has on the plate cylinder, because a rapid sequence of impacts of the ductor roll against the distributing roll urges the printing apparatus to approach a steady-state condition in which the torsional load generated by those impacts is sustained at a relatively constant level. This is in distinction to the oscillations between application and release of the torsional loads experienced in the prior art in reaction to each intermittent impact of the ductor roll.

The ductor roll is preferably reciprocated at a rate equal to approximately one-quarter of a cycle per one rotation of the plate cylinder, and is found to perform effectively when reciprocated at a rate within a range from approximately one-quarter to two cycles per rotation of the plate cylinder.

Further in accordance with the invention, the ductor roll preferably is held in the second position in ink transferring relationship with the distributing roll for a period of time in which the ductor roll rotates through less than two complete turns about its axis. In addition to minimizing the disruptive effect of the ductor roll on the plate cylinder as described above, this feature of the invention enables the ductor roll to apply a more even coating of ink to the distributing roll. More frequent applications of ink progressively develop an even coating and avoid the excessively inked condition known in the art as "ductor surge" wherein a globular mass of ink is deposited on the distributor roll.

In accordance with another embodiment of the present invention, a reciprocating metering roll is supported in ink transferring relationship with a distributing roll as the metering roll is moved into and out of ink transferring relationship with the fountain roll. Preferably, an adjusting means enables the pressure between the engaged surfaces of the metering roll and the distributing roll to be adjusted. Adjustment of the pressure between the engaged metering roll and distributing roll surfaces enables and controls slipping between those surfaces as a result of the difference in surface speed caused by contact of the metering roll with the fountain roll. The torsional load developed at the surface of the distributing roll can thereby be reduced as the metering roll is permitted to slip against the distributing roll while it is engaged with the more slowly moving surface of the fountain roll.

BRIEF DESCRIPTION OF THE DRAWINGS

These and other features of the present invention will become more apparent upon a consideration of the following description taken in connection with the accompanying drawings wherein.

DESCRIPTION OF THE PREFERRED EMBODIMENTS

Figure 1:
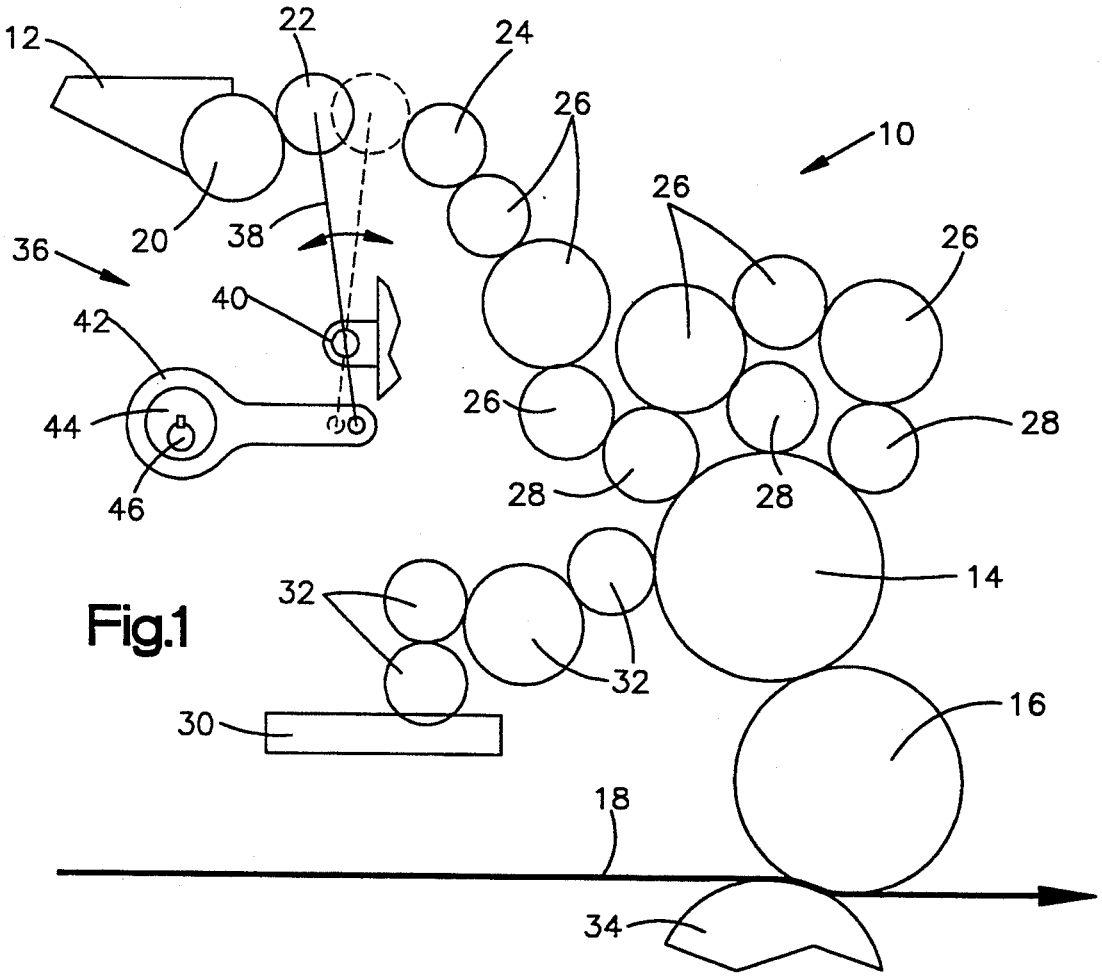
FIG. 1 is a schematic drawing of a printing apparatus incorporating the preferred embodiment of the present invention.

A printing apparatus 10 incorporating the present invention is illustrated in FIG. 1. The apparatus 10 is an offset printing apparatus comprising a plurality of rolls for transferring ink from an ink fountain 12 to a plate cylinder 14, which carries an image to be printed, and a blanket cylinder 16 which transfers the inked image from the plate cylinder 14 to a moving paper web 18.

A fountain roll 20 is driven to rotate with a relatively slow surface speed to pick up ink from the ink fountain 12. A ductor roll 22 is reciprocated between the fountain roll 20 and a distributing roll in order to transfer ink from the fountain roll 20 to the distributing roll. In the preferred embodiment, the distributing roll to which the reciprocating ductor roll delivers ink is a vibrator roll 24. A series of other distributing rolls 26 transfer ink from the vibrator roll 24 to a group of form rolls 28, which in turn transfer the ink to the plate cylinder 14. The vibrator roll 24, the other distributing rolls 26, the form rolls 28 and the plate cylinder 14 are driven by a common gear train to rotate with a surface speed greater than the speed of the fountain roll 20.

The printing apparatus 10 further comprises a dampening solution reservoir 30, and a series of dampening solution distributing rolls 32 for transferring a film of dampening solution to the plate cylinder 14. A second blanket cylinder 34 is shown only partially in FIG. 1 to represent a second printing apparatus similar to the printing apparatus 10 for printing sixeultaneously on the opposite side of the paper web 18.

The ductor roll 22 is supported on a reciprocating mechanism 36. The reciprocating mechanism 36 comprises a support member 38 pivotally mounted on a base menlber 40, with one end supporting the ductor roll 22 and the other end pivotally mounted on an arm 42. An eccentric 44 is keyed to a shaft 46 and Journalled in the arm 42 to impart reciprocating motion to the arm 42 in response to rotation of the shaft 46 by a driving means (not shown). Reciprocating motion of the arm 42, in turn, imparts reciprocating motion to the ductor roll 22 through the pivotal support member 38.

The reciprocating mechanism 36 moves the ductor roll back and forth between a first position shown in solid lines in FIG. 1, and a second position shown in dashed lines. When in the first position, the surface of the ductor roll 22 is in ink transferring relationship with the surface of the fountain roll 20 with the ductor roll 22 being rotatably driven by the fountain roll 20. The ductor roll 22 is held in the first position to pick up a quantity of ink, and is then moved to the second position,in ink transferring relationship with the vibrator roll 24. Ink is transferred from the ductor roll 22 onto the vibrator roll 24 for subsequent distribution to the plate cylinder 14 and the blanket cylinder 16. A duct cycle is completed as the ductor roll 22 is moved back to the first position in ink transferring relationship with the fountain roll 20 to replenish the supply of ink carried thereon.

As the ductor roll 22 is driven by the relatively slowly rotating fountain roll 20 when in the first position, it reaches a rotating surface speed which is less than the rotating surface speed of the vibrator roll 24. When the ductor roll 22 is moved into the second position in ink transferring relationship with the vibrator roll 24, the vibrator roll 24 accelerates the ductor roll 22 toward the rotating surface speed of the vibrator roll 24. Impact of the slowly moving ductor roll surface against the rapidly moving vibrator roll surface generates a torsional shock which resists the steady rotation of the vibrator roll 24. Since the vibrator roll 24, the other distributing rolls 26, the form rolls 28 and the plate cylinder 14 are driven together by a common gear train, a torsional load applied to the vibrator roll 24 is transmitted through the gear train to the other rolls. The reciprocating ductor roll 22 has this effect on the gear train each time it is moved into ink transferring relationship with the vibrator roll 24.

In practice of the present invention, it is found that reciprocation of the ductor roll 22 at a rapid rate applies a correspondingly rapid succession of torsional shocks to the vibrator roll 24, with the result that a torsional load transmitted to the gear train is not entirely diminished before application of the next successive torsional shock. This has the effect of introducing a sustained level of torsional loading in the gear train which fluctuates rapidly in response to rapid reciprocation of the ductor roll 22, but which does not drop or rise to a great degree in the short time between impacts of the ductor roll 22. Rapid reciprocation of the ductor roll 22 thus urges the printing apparatus 10 toward a steady-state condition wherein a relatively consistent level of torsional loading is experienced in the gear train between the vibrator roll 24 and the plate cylinder 14. The plate cylinder 14 will then transfer the inked image to the blanket cylinder 16 more steadily than in prior art systems wherein gear trains are jolted with the application and release of separate torsional loads with each impact of a ductor roll.

In accordance with the invention, the ductor roll 22 is reciprocated through a duct cycle from the first position to the second position and back to the first position at a rate exceeding the prior art rate of one-sixth of a duct cycle per one rotation of the plate cylinder. Preferably, the ductor roll 22 is reciprocated at a rate of approximately one-quarter of a duct cycle per one rotation of the plate cylinder 14, and is found to perform effectively throughout a range of rates between approximately one-quarter and two duct cycles per one rotation of the plate cylinder 14.

Rapid reciprocation of the ductor roll 22 is found also to apply a more even coating of ink to the vibrator roll 24 by means of frequent pick up and deposition of smaller quantities of ink. It is known in the prior art to hold a ductor roll in engagement with a vibrator roll throughout two complete rotations of the ductor roll in order to transfer a relatively greater quantity of ink. This sometimes results in a condition known as ductor surge wherein a globular deposition of ink must be smoothed out by the vibrator roll and the successive distributing rolls. Ductor surge is avoided in practice of the present invention with the ductor roll 22 being held in engagement with the vibrator roll 24 for a period of less than two full rotations of the ductor roll 22.

Figure 2:
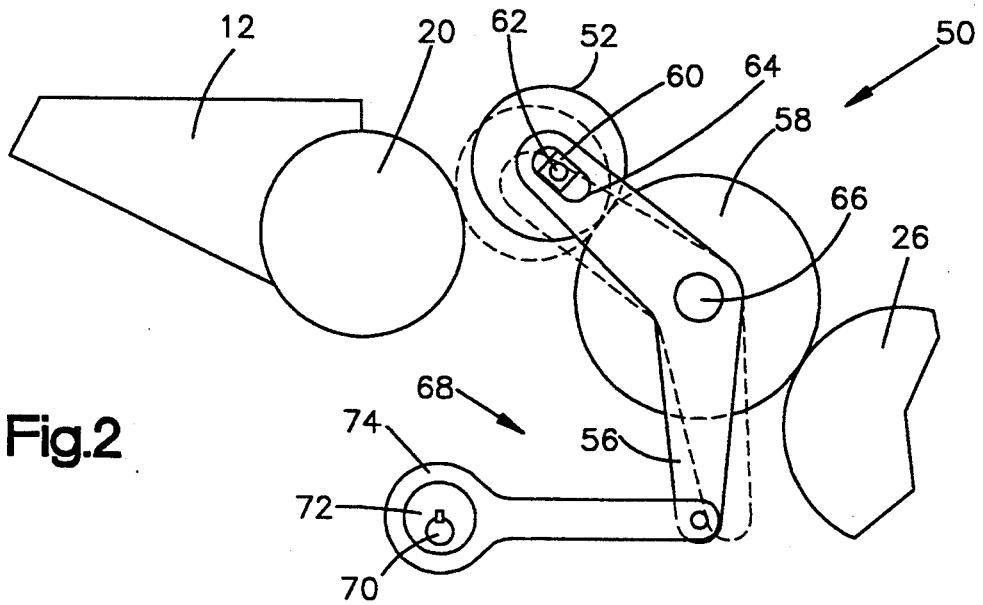
FIG. 2 is a schematic drawing of a printing apparatus incorporating an alternate embodiment of the present invention.

Another printing apparatus 50 incorporating an alternate embodiment of the present invention is illustrated in FIG. 2. In this embodiment of the invention, a reciprocating metering roll 52 is supported by a frame 56 at a position continuously in ink transferring relationship with a vibrator roll 58. An adjusting means comprises a bearing member 60 in which a stub shaft 62 of the reciprocating metering roll 52 is journalled. The bearing member 60 is adjustably locatable in a slot 64 in the frame 58 to adjust the supported position of the reciprocating metering roll 52 radially with respect to the vibrator roll 58. Adjustment of the reciprocating metering roll 52 on the frame 56 controls the degree to which the surface of the reciprocating metering roll 52 is pressed into driven rolling engagement with the surface of the vibrator roll 58. Driven rolling engagement is understood to include a film of ink between the engaged roll surfaces.

The frame 56 is pivotal about the vibrator roll axis 66 and is associated with a reciprocating mechanism 68 to be moved between a first position shown in dashed lines and a second position shown in solid lines. Reciprocation of the frame 56 is accomplished as a driving means (not shown) rotates a shaft 70. An eccentric 72 is keyed to the shaft 70 and journalled in an arun 74 to/anpart reciprocating motion to the arm 74 and to the pivotally connected frame 56. The reciprocating metering roll 52 is held in ink transferring relationship with the fountain roll 20 when the free 56 is in the first position, and is held out of ink transferring relationship with the fountain roll 20 when the frame 56 is in the second position.

The reciprocating metering roll 52 transfers ink onto the vibrator roll 58 as it is driven by the vibrator roll 58. When the frame 56 moves back from the second position to the first position to move the reciprocating metering roll 52 into ink transferring relationship with the fountain roll 20, the slowly moving surface of the fountain roll 20 exerts a resistance against the surface of the reciprocating metering roll 52 which is driven by the more rapidly moving surface of the vibrator roll 58. This generates a torsional shock against the vibrator roll 58 which is transmitted through the gear train to the plate cylinder 14. The frame 56 is reciprocated between the first and second positions at a rapid rate in accordance with the invention to urge the printing apparatus 50 toward a steady-state condition as described above with respect to operation of the printing apparatus 10, whereby the detrimental effect of the torsional loading is minimized.

Additionally, the adjusting means enables the pressure between the engaged surfaces of the reciprocating metering roll 52 and the vibrator roll 58 to be adjusted such that the reciprocating metering roll 52 is driven by the vibrator roll 58, but is permitted to slip in a controlled amount with respect to the vibrator roll 58 in response to the resistance of the slowly moving fountain roll surface when in the first position. The degree to which the vibrator roll 58 drives the reciprocating metering roll 52 through surface engagement is thereby reduced by impact of the reciprocating metering roll 52 with the fountain roll 20. This reduces the torsional shock between the engaged roll surfaces and consequently lowers the level of the sustained torsional loading in the gear train.

The invention has been described with reference to the preferred embodiments. However, alterations and modifications will become apparent to those of ordinary skill in the art to which the invention pertains upon reading the specification. It is understood that all such alterations and modifications are included within the scope of the invention as defined in the appended claims.

Having described a specific preferred embodiment of the invention, the following is claimed:

1. A printing apparatus for transferring ink to a rotatable plate cylinder, said printing apparatus comprising:

an ink fountain for containing a supply of ink;

a fountain roll for picking up ink from said ink fountain, said fountain roll having an outer surface rotatable at a first surface speed;

an ink distributing roll spaced from said fountain roll for transferring ink to said plate cylinder, said ink distributing roll having an outer surface rotatable at a second surface speed which is substantially greater than said first surface speed;

a ductor roll for transferring ink from said fountain roll to said ink distributing roll, said ductor roll being movable between a first position in contact with said outer surface of said fountain roll and a second position not in contact with said outer surface of said fountain roll but in contact with said outer surface of said ink distributing roll; and means for moving said ductor roll through a duct cycle from said first position to said second position and back to said first position at a rate of at least one quarter of a duct cycle per one rotation of said plate cylinder, including means for continuously holding said ductor roll in ink transferring relationship with said distributing roll and means for supporting said ductor roll in driven engagement with said distributor roll and for adjusting said rolls to permit slipping between the surface of said rolls.

* * * * *